United States Patent [19]

Slattery

[11] 4,085,580

[45] Apr. 25, 1978

[54] COMBUSTION CHAMBERS FOR GAS TURBINE ENGINES

[75] Inventor: Sidney Edward Slattery, Foston, England

[73] Assignee: Rolls-Royce Limited, London, England

[21] Appl. No.: 742,181

[22] Filed: Nov. 16, 1976

[30] Foreign Application Priority Data

Nov. 29, 1975 United Kingdom ..... 49138/75

[51] Int. Cl.[2] ..... F02C 7/18

[52] U.S. Cl. ..... 60/39.65; 60/39.66

[58] Field of Search ..... 60/39.65, 39.66

[56] References Cited

U.S. PATENT DOCUMENTS

| | | | |
|---|---|---|---|
| 2,651,912 | 9/1953 | Abbott | 60/39.65 |
| 2,657,531 | 11/1953 | Pierce | 60/39.66 |
| 2,664,702 | 1/1954 | Lloyd et al. | 60/39.65 |
| 2,699,648 | 1/1955 | Berkey | 60/39.65 |
| 2,919,549 | 1/1960 | Haworth et al. | 60/39.66 |
| 3,064,425 | 11/1962 | Hayes | 60/39.66 |
| 3,430,443 | 3/1969 | Richardson et al. | 60/39.65 |
| 3,869,864 | 3/1975 | Bunn | 60/39.66 |
| 3,952,503 | 4/1976 | Fox et al. | 60/39.71 |

*Primary Examiner*—Robert E. Garrett

*Attorney, Agent, or Firm*—Cushman, Darby & Cushman

[57] ABSTRACT

Plates are mounted over holes formed in the heat shield of a gas turbine engine combustion chamber, which plates are slightly spaced from the heat shield so that air issues radially outwardly from behind the plates to produce film cooling of the heat shield.

10 Claims, 6 Drawing Figures

10
12
14
16
18
20
22
24
26
28
30
31
32
34
36
37
38
40
42
44
46

COMBUSTION CHAMBERS FOR GAS TURBINE ENGINES

This invention relates to combustion chamber for gas turbine engines.

The upstream wall of the combustion chamber is exposed to very high temperatures in use and this wall is thus formed with a plurality of suitably arranged holes and/or slots which are adapted to receive air from the compressor in an effort to cool the wall.

It is an object of the present invention to provide a combustion chamber with an upstream wall which is more effectively cooled.

According to the present invention a gas turbine engine combustion chamber has an upstream wall comprising a perforated member with deflector means mounted adjacent to the perforated member downstream thereof, there being provided at least one aperture between the deflector means and the member whereby in operation air passing through at least some of the perforations in the perforated member is deflected by the deflector means and passes through the at least one aperture so as to travel over the surface of the perforated member and form a film of cooling air thereupon.

Preferably the perforated member comprises two spaced upstream and downstream portions, the deflector means being mounted adjacent to the downstream portion downstream thereof.

Figures 1, 2:
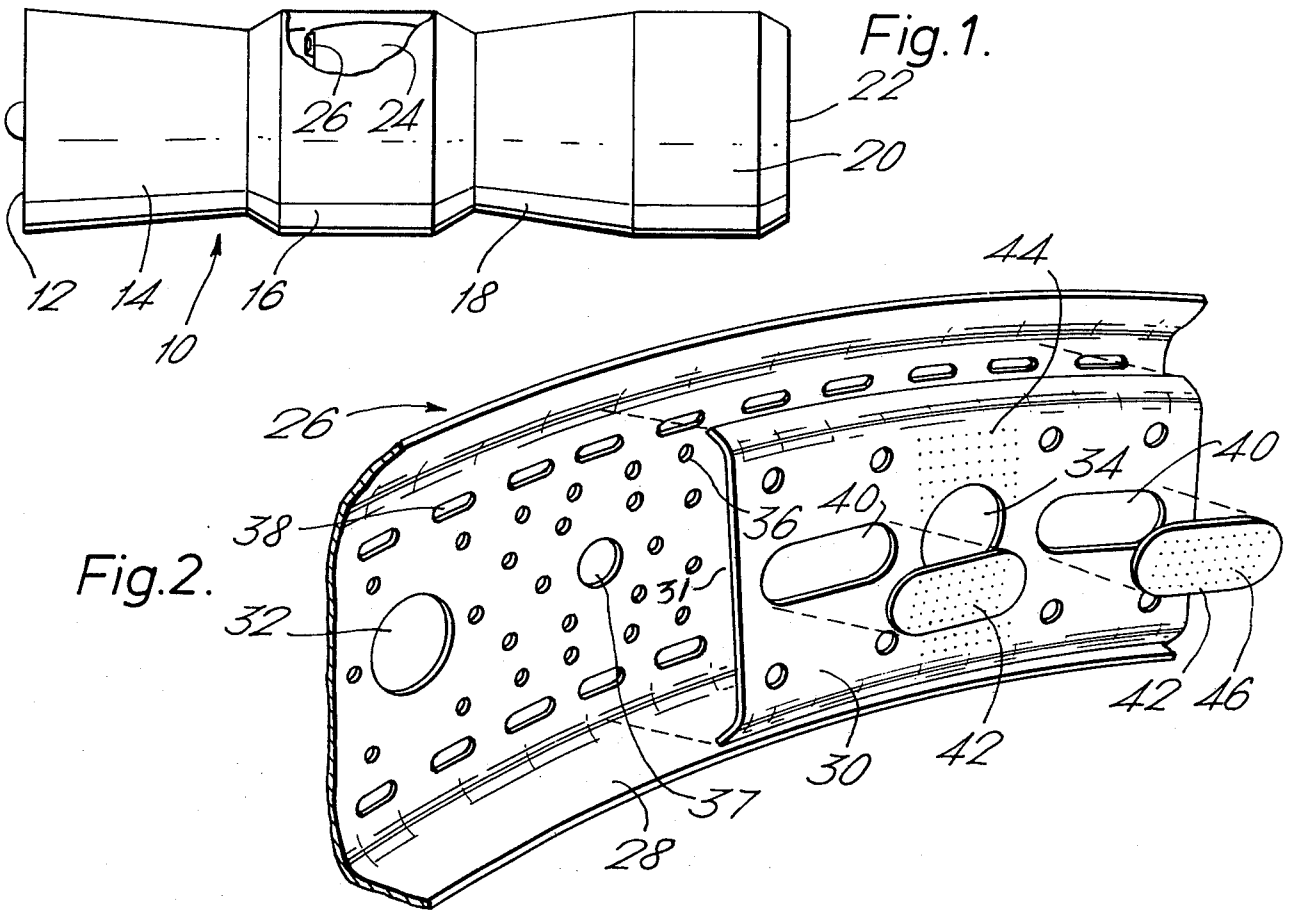
Figure 3:
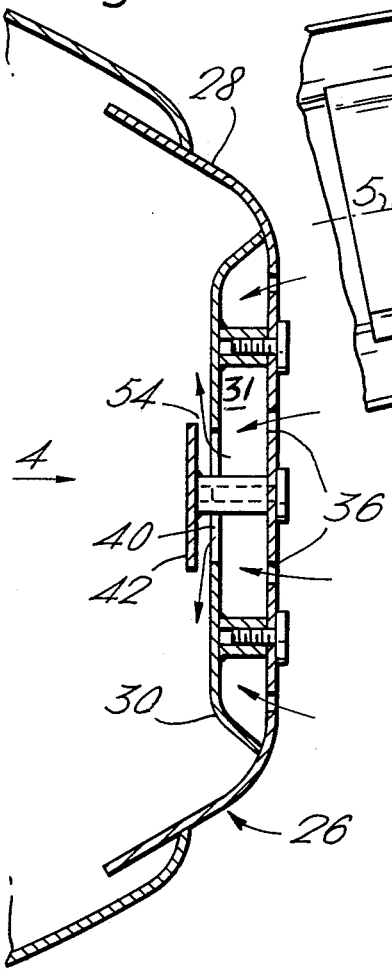
Figure 4:
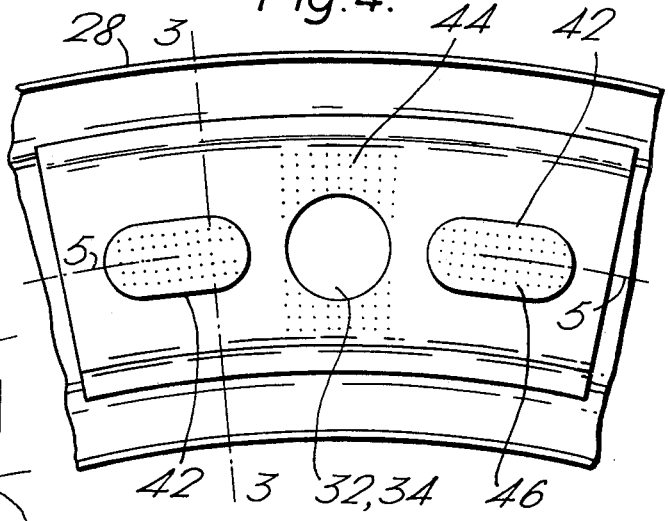
Figure 6:
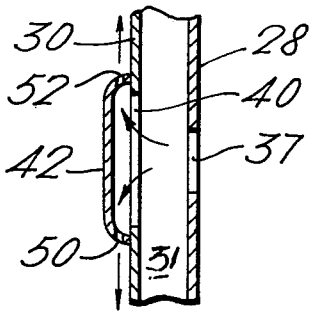
Figure 5:
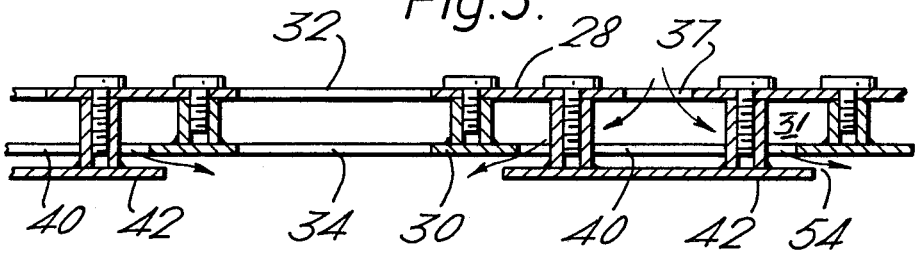

An embodiment of the present invention will now be described by way of example only with reference to the accompanying drawings in which FIG. 1 illustrates a gas turbine engine having a combustion chamber in accordance with the invention, FIG. 2 is an exploded view of a portion of the upstream wall of the combustion chamber, FIG. 3 is a cross-sectional view through the upstream wall of the chamber taken along the line 3—3 in FIG. 4, FIG. 4 is a view of the upstream wall from the arrow 4 in FIG. 3, FIG. 5 is a cross-sectional view through the upstream wall along line 5—5 in FIG. 4, and FIG. 6 is a partial view of an alternative embodiment of the invention.

In FIG. 1 there is shown a gas turbine engine 10 having an air intake 12, compressor means 14, combustion equipment 16, turbine means 18, a jet pipe 20 and an exhaust nozzle 22. The combustion equipment 16 consists of a combustion chamber 24 which, in this case, is annular and has an upstream wall 26 through which air from the compressor means 14 passes and in which is located a number of circumferentially arranged burners. An exploded view of a portion of the upstream wall 26 is shown in FIG. 2.

The wall consists basically of two parts, a meter panel 28 and a heat shield member 30 axially spaced downstream of the meter panel and defining with the meter panel, a first plenum chamber 31. The heat shield 30 consists of 18 separate parts as shown which are bolted in abutting relationship to the meter panel 28. The meter panel 28 is provided with larger holes 32 through which the burners project, and the heat shield portions 30 are similarly provided with holes 34 which align with the holes 32. The meter panel is also provided with a plurality of smaller holes 36 and 37 and slots 38 through which air can pass to impinge on the inside of the heat shield portions 30. Arranged on each side of each of the holes 34 in the heat shield member 30 is an elongate slot 40 and over each of the slots is mounted an elongated deflector plate 42. The dimensions of each deflector plate are greater than those of each slot 40, and each plate 42 is mounted so as to be spaced away from the surface of the heat shield portion 30 to form a radial gap defining a second plenum chamber 54 (see FIGS. 3 and 5). This arrangement causes the air which has passed through the holes 36,37 in the meter panel to flow radially outwardly from behind the deflector plate 42 and over the surface of the heat shield portions 30 to create a film of cooling air thereon.

Further very small holes can be provided in the heat shield portions 30 such as shown at 44, and in the deflector plates 42 as shown at 46 for the admission of cooling air to the downstream surfaces of the heat shield portions and the deflector plates.

It will be seen that the positions and shapes of the holes 40 and the deflector plates 42 can be varied to suit particular requirements, such as different shapes or sizes of burners.

An alternative method of mounting the deflector plates comprises forming each deflector plate with a rim 50 and welding or otherwise bonding the rim to the heat shield. In this case the rim is provided with a plurality of radial holes or apertures 52 whereby air is allowed to flow radially from the rim of the deflector plate and form a film of cooling air on the surface of the heat shield.

I claim:

1. An axially extending combustion chamber for a gas turbine engine, the combustion chamber having an upstream wall for admission of air to the interior of the chamber and for cooling the wall, said upstream wall comprising:

a perforated upstream meter panel and a perforated heat shield member spaced axially downstream of said perforated meter panel, said perforated meter panel and said perforated heat shield member defining a plenum chamber therebetween whereby in operation of the engine, air passes through said perforated upstream meter panel into said plenum chamber and impinges on the upstream side of said perforated heat shield to cool the same, said heat shield member having a plurality of enlarged openings therein in addition to the perforations, a plurality of deflector plates axially spaced downstream from said perforated heat shield member in alignment with said openings, each of said deflector plates having a dimension greater than each of said openings, and said heat shield member and said deflector plates defining a plurality of second plenum chambers axially downstream of said first plenum chamber, each of said second plenum chambers having at least one radially directed aperture formed therein whereby air passing axially downstream from said first plenum chamber through said openings in said perforated shield member into said second plenum chambers is directed radially outwardly as a cooling film over the downstream side of said heat shield member to further cool the same and protect said perforated meter panel from heat within said combustion chamber.

2. A gas turbine engine combustion chamber as claimed in claim 1 wherein each said deflector plate is provided with a plurality of very small holes for the admission of cooling air axially therethrough.

3. A gas turbine engine combustion chamber as claimed in claim 1 wherein each said deflector plate is formed with a rim, said rim being secured to said heat shield member by welding or bonding.

4. A gas turbine engine combustion chamber as claimed in claim 3 wherein the radially directed aperture in each of said second plenum chambers is defined by a plurality of radial holes in each rim of each of said deflector plates.

5. A gas turbine engine combustion chamber as claimed in claim 4 wherein said perforated heat shield member comprises a plurality of separate portions, said separate portions being adapted to abut in end to end relationship, and each being adapted to be secured to said perforated meter panel.

6. A gas turbine engine combustion chamber as claimed in claim 5 wherein said perforated meter panel is provided with holes adapted to receive burners, and each separate portion of said heat shield member is provided with an aligned hole to receive a burner.

7. A gas turbine engine combustion chamber as claimed in claim 5 wherein each said separate portion of said heat shield member is provided with a plurality of very small holes for the admission of cooling air axially therethrough.

8. A gas turbine engine combustion chamber as defined in claim 6 wherein the openings in each separate portion of said heat shield member is provided with one of said openings arranged on each side of said hole to receive the burner, said openings being elongated.

9. A gas turbine engine combustion chamber having an upstream wall, said upstream wall comprising:

a perforated member; and a plurality of deflector plates mounted adjacent to and spaced downstream from said perforated member, each of said deflector plates being provided with a plurality of very small holes for admission of cooling air therethrough, at least one radial aperture between each of said deflector plates and said perforated member whereby in operation, air passing through at least some of the perforations in said perforated member is deflected by said deflector plates and passes through said at least one aperture so as to travel over the surface of said perforated member and form a film of cooling air thereupon.

10. A gas turbine engine combustion chamber having an upstream wall, said upstream wall comprising:

a perforated member having two spaced upstream and downstream portions, said downstream portion of said perforated member comprising a plurality of separate plates each of which is provided with a plurality of very small holes for the admission of cooling air therethrough and said separate plates being adapted to abut in end to end relationship and being secured to said upstream portion; and deflector means, said deflector means being mounted adjacent to said perforated member downstream thereof, there being provided at least one aperture between said deflector means and said perforated member, whereby in operation, air passing through at least some of the perforations in said perforated member is deflected by said deflector means and passes through said at least one aperture so as to travel over the surface of said perforated member and form a film of cooling air thereupon.

* * * * *